United States Patent [10]

Potter

[11] 4,052,805

[45] Oct. 11, 1977

[54] CARD AND BULLETIN DISPLAYER MOUNTING ON WALL OR DOOR

[76] Inventor: Glenn James Potter, 1332 S. Hope St., No. 302, Los Angeles, Calif. 90015

[21] Appl. No.: 635,669

[22] Filed: Nov. 26, 1975

[51] Int. Cl.[2] ..... G09F 1/10

[52] U.S. Cl. ..... 40/124; 40/128; 211/118

[58] Field of Search ..... 40/124, 124.2, 124.4, 40/125 G, 153, 128; 38/102.4–102.6; 211/104, 118, 113, 86, 87; 248/466, 441 R; 160/378

[56] References Cited

U.S. PATENT DOCUMENTS

| | | | |
|---|---|---|---|
| 1,812,077 | 6/1931 | Belash | 40/124.4 |
| 2,620,579 | 12/1952 | Dienes | 40/129 C |
| 3,170,260 | 2/1965 | Parker | 40/124 |
| 3,327,419 | 6/1967 | Stanos | 40/124 |
| 3,853,226 | 12/1974 | Hine et al. | 40/124.4 X |

*Primary Examiner*—John F. Pitrelli

[57] ABSTRACT

Seasonal greeting cards, other cards, and bulletins are fastened with a stapler to one, or several spaced sturdy tapes held stretched just off a vertical wall or door or in a doorway. Each tape may be looped over an upper slat hooked or otherwise fastened on a molding, and adjustably looped below on a double hook slung by resilient means to a lower slat fastened to a baseboard. Spacing off plane vertical surfaces is provided by slat mountings consisting of lengths of Z-section extrusions or the like. Space is allowed for the lower jaw of the stapler to slip behind the tape. The lower portion of the tape is passed around the middle of the double hook and adjusted for length and tension by a slide. A slot over the middle of each hook guides and stabilizes the tape. Tapes may be mounted horizontally, and also singly, by suitable links in the shape of stirrups, frames, and the like.

6 Claims, 4 Drawing Figures

CARD AND BULLETIN DISPLAYER MOUNTING ON WALL OR DOOR

Many structures have been invented for displaying cards and bulletins. One such is described here, adaptable to many uses. For simplicity, this presentation visualizes the display of a large number of seasonal greeting cards especially Christmas cards, in the home or office, but it is understood that no limitation to a particular kind of display matter is being made.

To be helpful, a device for this purpose ought to accommodate upwards of 100 Christmas cards of diverse shapes and sizes and should take up little room in use and in storage. Setting up should not be troublesome; and the individual cards should be mountable rectilinearly quickly and easily, with little or no damage, in a way so that they can be opened out and read while remaining attached. Adaptations for the home, employing multi-pocketed cabinets patterned after those for retailer's displays have the disadvantages of taking up considerable space and being heavy and cumbersome, because of construction with a separate pocket for each card. A device fastening on a wall or door would require almost no space, and it would not tumble over like a free-standing model, for instance one intended to resemble a Christmas tree. A stretched cloth screen forms the base for some models, but may have the disadvantage of being free-standing. Pinning of the cards almost requires a third hand in the back. Pins, whether straight, or curved near the tip, split the paper, allowing the cards to tilt untidily, and the parts of the pins showing are unsightly.

If a series of broad stout tapes could be stretch side-by-side vertically about 7 inches apart, close off a wall of the home or office, they could form a practical base for the stapling on of greeting cards by means of an ordinary home desk model stapler. The objects of the present invention are to overcome the stated disadvantages of previous models, providing saving of space, negligible damage to cards and supporting tapes, versatility in accommodating various sizes and shapes of cards, ease of mounting in neat horizontal alignment, and resuseability.

Operation of the card and bulletin displayer is as follows. The two crossbars or slats which support and stretch the tapes are easily mounted on vertical wood surfaces, and can be remounted in succeeding years. Expansion bolts may be used on plaster and concrete walls. The mounts may be left up year after year and the slats removed seasonally. With the slats in position, the tapes are looped over the top slat and secured by threading through slides (or buckles). Below, each tape is passed through another slide or buckle and looped around the middle of a double hook member in the nature of a bent rod to which a member is attached bearing a slot arranged to received and guide the tape as it passes down and back around the midportion of the double hook. The tape is adjusted long enough that the double hook just clears the lower slat. Rubber bands are slipped over the hooks, brought down behind the slat, then forward and up, to be hooked on a second time. Then the tape is readjusted shorter until it is held tense by the stretched rubber bands. In one embodiment, the double hook member has a slotted angle section member screwed at two points to its middle, arranged to adjustably clamp and hold the tape at a selected length. In this embodiment a slide is not required below. Each tape is so held by the double hook member and rubber bands below that it is stretched out in a plane paralleling the plane of the wall, with room between tape and wall for insertion of the lower jaw of a stapler. Temporary distortion is allowed for, so that the cards may be positioned and attached with ease, and by one person; and the cards may be tucked behind one another at their edges if desired. Cards fashioned folded over at the top may be overlapped to save space and look their neatest. Five tapes separated 6½ to 7 inches apart will accommodate 75 full-size and over-size card, or 100 cards of assorted sizes. The top loop of a tape and the rubber bands at the bottom end may be moved along the slats to vary the distance between the tapes. Cards with top folds may be arrayed on the first, third, and fifth tapes, and narrower, side-folded cards may be fastened on the second and fourth tapes. Mounting on a wide door is possible; or double mounting, back-to-back, in a doorway. The tapes may be mounted horizontally, whereupon they may conveniently hold many closely set side-folded cards. Instead of being all stretched between two long slats, the tapes may each be mounted on the wall or door independently.

The accompanying drawing helps clarify the description of my invention.

Figure 1:
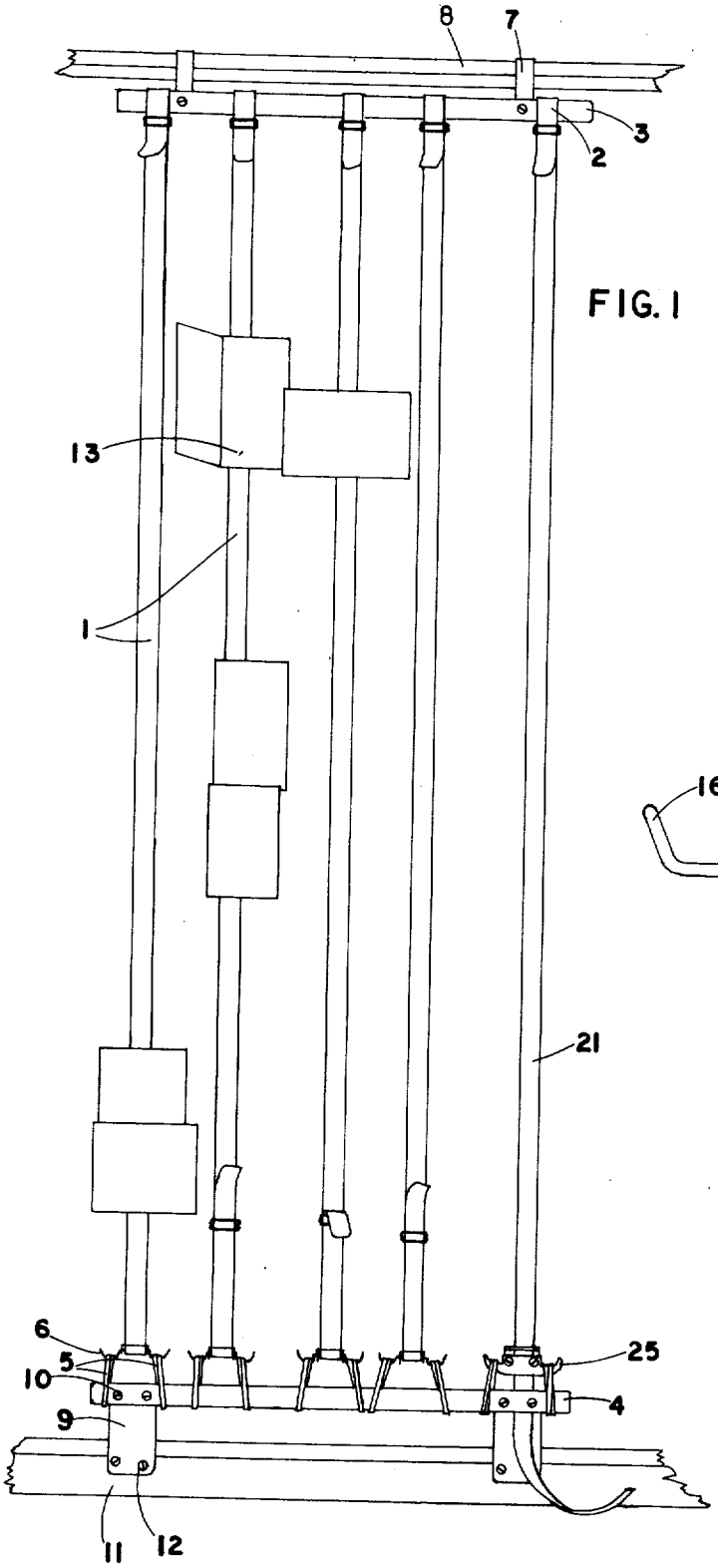
FIG. 1 is a front view of the whole card and bulletin displayer.

As shown in FIG. 1, a number of webbing straps or tapes 1 are stretched vertically by having their looped ends 2 attached to an upper horizontally crossbar 3 and their lower ends pulled down toward a lower horizontal crossbar 4 by a pair of elastic bands 5 each, transmitting the pull by way of a rigid medial elongation of a double hook member 6 attached to each tape. The double hook with its tape guide and the elastic bands comprise the linkage means of the invention. The upper crossbar is suspended by two flats hooks 7 fitting picture molding 8 and bolted to the back of the crossbar; or it may be bolted to two flat plates which are screwed to the molding. The lower crossbar is fastened on the front side of two flat plates 9 by bolts 10, and these plates are fastened to the baseboard 11 by wood screws 12. The tapes stand off the wall far enough to admit the lower jaw of a stapler held in the hand, and one card 13 after another is fastened on.

Figure 2:
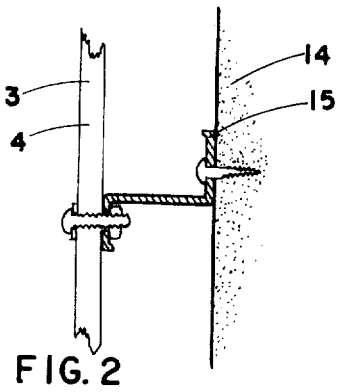
FIG. 2 is a cross-sectional view of a mounting for the upper or lower crossbar going on a plane vertical wall or door.

FIG. 2 shows in cross-section a mount for fastening the crossbars to a plane vertical wall 14, employing short lengths of Z-section extrusion 15.

Figure 3:
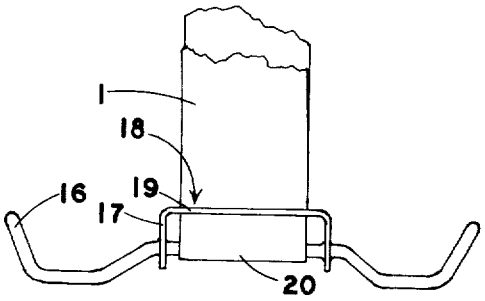
FIG. 3 is a detailed front view of a device for fastening a tape to the lower crossbar.

In FIG. 3, rod 16 is bent in the form of a double hook. Elastic bands, one for each hook, slung around the lower crossbar, provide downward pull, keeping the tape 1 in one plane yet supplying give to make stapling of the greeting cards easy. Guide 17 keeps the tape aligned over the lower crossbar by having a narrow slot 18 along its horizontal portion 19, affording just room enough for the tape to pass down and back up through it as the tape loops around the mid-portion 20 of the double hook.

Figure 4:
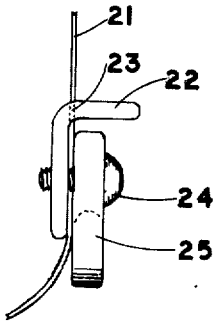
FIG. 4 is an end view of another device for fastening a tape to the lower crossbar.

The double hook device shown in end view in FIG. 4 can be adjustably fastened along tape 21 at a selected height above the lower slat. Angle section length 22 has a slot 23 which guides and aligns tape 21 and furthermore has two threaded holes by means of which two screws 24 draw it tightly against the double hook member 25, gripping the intervening tape.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

I claim:

1. Structures for displaying cards and bulletins comprising the combination of: a plurality of common sturdy tapes on which a plurality of cards are affixed each of said tapes is stretched out and held in a recoverably displaceable manner in a substantially vertical plane; a first fixation means mounted on a building comprising a crossbar holding a first end of at least one of said tapes; a linkage means holding said one tape at its second end, said linkage means comprising: a double hook member having hooks adjacent each side of said tape and joined by a rigid medial elongation member adapted to engage and hold said tape, and a pair of elastic bands each looped over one of said hooks and over a crossbar rigidly joined to a second fixation means mounted on said building said elastic bands are held in tension between said hooks and crossbar thereby causing said linkage to resiliently stretch said tape tautly; adjustment means for changing and maintaining the effective length of said tape between said first fixation means and said linkage means comprising a plurality of buckles for adjusting and maintaining said effective lengths of said plurality of tapes when said tapes are doubled back to form end loops; said second fixation means comprising spacer means whereby said tapes are held away from said building far enough that a jaw of a common stapler may be inserted behind said tapes for removably affixing a plurality of cards along the length of each said tape.

2. The construction of claim 1 wherein said double hook member comprises a rigid medial elongation in the form of a plate, said plate bearing a cross-slot which just admits said tape for threading through and guidance, two screws fitting holes in said cross-slotted plated and matching threaded holes in said rigid medial elongation, said screws with their holes arranged on each side of said tape and adjustably locking said double hook member on said tape by the manipulation of said screws.

3. The construction of claim 1 wherein said fixation means comprise first and second crossbars, and plates to which each is rigidly attached, said plates having holes by which said plates are fastened by elongated penetrative means to a picture molding in the case of one said crossbar and to a baseboard in the case of the other crossbar, to thereby provide said spacer means and allow room behind said tape for a jaw of a common stapler.

4. The construction of claim 1 wherein one of said first and second fixation means has said crossbars rigidly attached to mountings consisting of short lengths of Z-section extrusion said extrusions holding each said tape away from close proximity to said building to thereby provide said spacer means, said mountings having holes for securing said fixation means to said building by elongated penetrative means.

5. The construction of claim 1 wherein each of first and second fixation means comprises crossbars, a pair of strong rigid narrow curved metal straps attached to one said crossbar for hooking it to an available picture molding, and flat plates attached to the other crossbar and having holes for fastening said plates to a baseboard by elongated penetrative means.

6. The construction of claim 1 wherein said crossbar is of sufficient length to maintain a plurality of said tapes stretched out by their ends, spaced along the lengths of said crossbar and displaying a totality of several dozens of fastened-on cards.

* * * * *